US011649126B2

(12) United States Patent
Yasutaka et al.

(10) Patent No.: US 11,649,126 B2
(45) Date of Patent: May 16, 2023

(54) PAPER SHEET CIRCULATION DEVICE AND CIRCULATION-TYPE PAPER SHEET HANDLING DEVICE

(71) Applicant: Japan Cash Machine Co., Ltd., Osaka (JP)

(72) Inventors: Hirokazu Yasutaka, Osaka (JP); Yoshimi Ezawa, Osaka (JP); Tomonori Kitano, Osaka (JP); Hiroji Ishihata, Osaka (JP); Toru Seki, Osaka (JP)

(73) Assignee: Japan Cash Machine Co., Ltd., Osaka (JP)

( * ) Notice: Subject to any disclaimer, the term of this patent is extended or adjusted under 35 U.S.C. 154(b) by 405 days.

(21) Appl. No.: 16/645,449

(22) PCT Filed: May 10, 2018

(86) PCT No.: PCT/JP2018/018196
§ 371 (c)(1),
(2) Date: Mar. 6, 2020

(87) PCT Pub. No.: WO2019/049422
PCT Pub. Date: Mar. 14, 2019

(65) Prior Publication Data

US 2020/0283251 A1 Sep. 10, 2020

(30) Foreign Application Priority Data

Sep. 8, 2017 (JP) ..... JP2017-172862

(51) Int. Cl.
*B65H 5/28* (2006.01)
*B65H 26/02* (2006.01)

(52) U.S. Cl.
CPC ..... *B65H 5/28* (2013.01); *B65H 26/02* (2013.01); *B65H 2301/41912* (2013.01)

(58) Field of Classification Search
CPC ..... B65H 5/28; B65H 26/02; B65H 2301/41912; B65H 2511/521;
(Continued)

(56) References Cited

U.S. PATENT DOCUMENTS 5,028,965 A 7/1991 Kinoshita et al.
7,654,485 B2 2/2010 Rossel et al.
(Continued)

FOREIGN PATENT DOCUMENTS

EP 1 710 181 * 10/2006
JP H02-86571 A 3/1990
(Continued)

OTHER PUBLICATIONS

English/French Translation of WO 2010/052795—Goto (Year: 2010).*
(Continued)

*Primary Examiner* — William A. Rivera
(74) *Attorney, Agent, or Firm* — Masuvalley & Partners; Peter R. Martinez

(57) ABSTRACT

To prevent a failure or the like caused by winding of a tape in a reverse direction to a proper direction, a paper sheet circulation device includes a travelling-direction mark having a pattern that is formed along a travelling-direction of a detection tape and indicates the difference of the travelling-direction of the tape, and a sensor module that detects the travelling-direction mark and outputs a detection signal. The paper sheet circulation device determines a travelling-direction of the tape from a pattern signal in accordance with the travelling-direction of the tape acquired on the basis of a temporal change of the detection signal, and determines a winding direction of the tape on a drum from the travelling-direction of the tape and a rotation direction of the drum.

9 Claims, 9 Drawing Sheets

(58) Field of Classification Search
CPC ..... B65H 2511/528; B65H 2513/41; B65H 2701/1912; B65H 29/006; B65H 29/51; G07D 11/13; G07D 11/23; G07D 11/235; G07D 9/00
See application file for complete search history.

(56) References Cited

U.S. PATENT DOCUMENTS

| | | | | |
|---|---|---|---|---|
| 8,302,757 | B1 * | 11/2012 | Angus | B65H 5/28 271/216 |
| 2002/0113160 | A1 * | 8/2002 | Niioka | B65H 29/006 242/412.1 |
| 2005/0078015 | A1 * | 4/2005 | Ferran | G01D 5/2457 341/11 |
| 2011/0073611 | A1 * | 3/2011 | Tosaka | B65H 43/08 221/71 |
| 2011/0079675 | A1 * | 4/2011 | Iwatsuki | G07D 11/12 242/397 |
| 2012/0104015 | A1 | 5/2012 | Ebinuma et al. | |
| 2012/0181298 | A1 * | 7/2012 | Miki | G07D 11/12 221/71 |
| 2015/0014469 | A1 | 1/2015 | Iwatsuki | |
| 2017/0140599 | A1 | 5/2017 | Hemmi et al. | |
| 2017/0233207 | A1 | 8/2017 | Dettori et al. | |
| 2017/0323509 | A1 | 11/2017 | Takada. et al. | |
| 2018/0111779 | A1 | 4/2018 | Takada et al. | |

FOREIGN PATENT DOCUMENTS

| | | | |
|---|---|---|---|
| JP | 10-181972 | * | 7/1998 |
| JP | 2010-221485 | A | 10/2010 |
| JP | 2012-98763 | A | 5/2012 |
| JP | 2013-137619 | A | 7/2013 |
| JP | 2018-36892 | * | 3/2018 |
| TW | 201544307 | A | 12/2015 |
| TW | 201730852 | A | 9/2017 |
| WO | WO 2010/052795 | * | 5/2010 |
| WO | WO2016/076048 | A1 | 5/2016 |
| WO | WO2016/185859 | A1 | 11/2016 |

OTHER PUBLICATIONS

WIPO, Japanese International Search Authority, International Search Report (with English translation) and Written Opinion dated Jul. 31, 2018 in International Patent Application No. PCT/JP2018-018196, 7 pages.
EPO, Extended European Search Report dated May 4, 2021 in European Application No. EP 18853928.2, 6 pages.

* cited by examiner

PLAIN VIEW

LEFT SIDE VIEW

FRONT VIEW

FIG.5
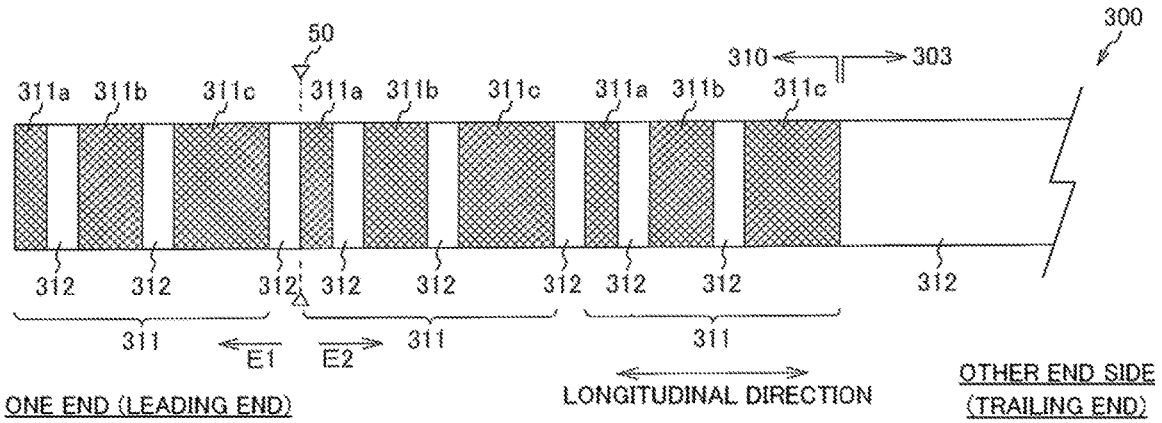
FIG.6(a) AT TIME OF DISPENSING BANKNOTE (NORMAL STATE)
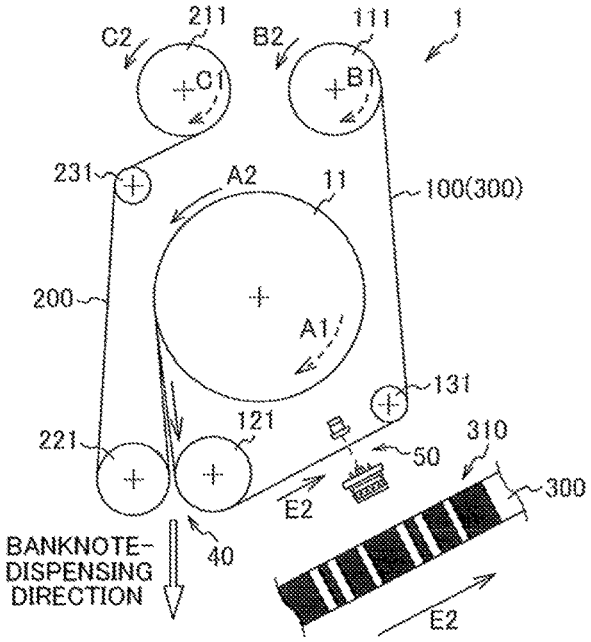
FIG.6(b) AT TIME OF DISPENSING BANKNOTE (REVERSE WINDING STATE)
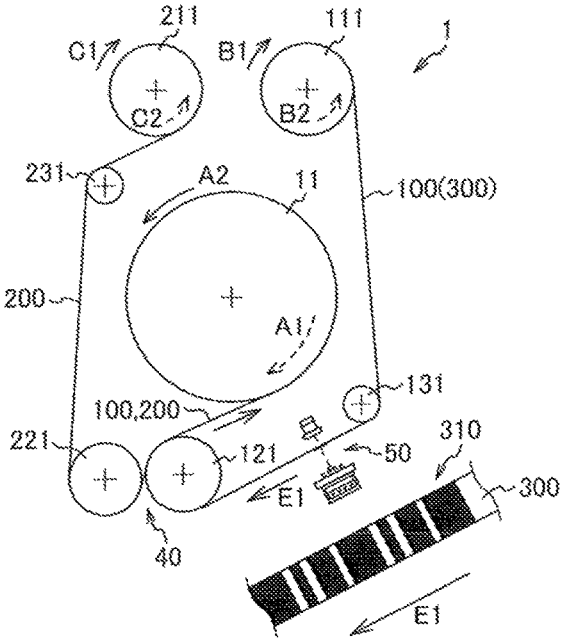

PAPER SHEET CIRCULATION DEVICE AND CIRCULATION-TYPE PAPER SHEET HANDLING DEVICE

RELATED APPLICATIONS

This application is the U.S. National Phase of and claims priority to International Patent Application No. PCT/JP2018/018196, International Filing Date May 10, 2018, entitled Paper Sheet Circulation Device And Circulation-Type Paper Sheet Handling Device; which claims benefit of Japanese Application No. 2017-172862 filed Sep. 8, 2017; both of which are incorporated herein by reference in their entireties.

FIELD

The present invention relates to a tape-winding type paper sheet circulation device provided in a circulation-type paper sheet processing device that has a function of storing paper sheets therein and discharging paper sheets, and more particularly relates to a tape-winding type paper sheet circulation device that can determine a winding direction of a tape on a drum and a circulation-type paper sheet handling device.

BACKGROUND

There are known various kinds of vending machines, cash deposit/dispense machines, money changers, and the like (circulation-type banknote handling devices) that have a cash deposit function of receiving an inserted banknote (a paper sheet) by denomination and a cash dispense function of dispensing a banknote as change or money to be returned.

Patent Literature 1 discloses a circulation-type banknote storing device that is a tape-winding type, including two tapes in the form of long strips, a drum to which one ends in a longitudinal direction of the two tapes are fixed while being overlapped on each other and which is rotatable in a forward direction and a reverse direction, and two reels to which the other ends in the longitudinal direction of the respective tapes are fixed and which are rotatable in a forward direction and a reverse direction. The circulation-type banknote storing device stores therein a banknote by sandwiching it between the two tapes wound in a multilayer state on an outer circumference of the drum.

In the tape-winding type paper sheet circulation device, it is determined which one of the ends in the longitudinal direction a corresponding tape end is, and rotation of the drum and the reels is controlled, in order to prevent damage or the like of the tapes by excessive tension applied on the tapes each having a limited length.

In the circulation-type banknote storing device of Patent Literature 1, a light-shielding region indicating a tape end is provided at a leading end and a trailing end of one of the tapes, and a light-shielding region indicating a tape end is provided at a trailing end of the other tape. Further, two tape sensors that detect surface states of the respective tapes are arranged in the circulation-type banknote storing device. In a case where only one of the two tape sensors detects the light-shielding region, it is determined that the corresponding tape end is the leading end of the tape. In a case where both the tape sensors detect the light-shielding regions, it is determined that the corresponding tape ends are the trailing ends of the tapes.

CITATION LIST

Patent Literature

Patent Literature 1: Japanese Patent Application Laid-open No. 2013-137619

SUMMARY

Technical Problem

When a banknote jam occurs inside a circulation-type banknote storing device, an operator may manually rotate a drum in a banknote-dispensing direction to remove a jammed banknote. However, when rotating the drum in the dispensing direction in a state where the remaining amount of a tape wound on the drum is low, the operator may continue to rotate the drum in the same direction without noticing that the remaining tape has been all fed from the drum. In this case, the tape is wound on the drum in an opposite direction to a proper winding direction. When the device is operated in this state, a banknote cannot be stored and fed smoothly, which may cause another banknote jam or a failure of the circulation-type banknote storing device.

The present invention has been made in view of the above problems and it is an object of the present invention to provide a circulation-type paper sheet storing device that is a tape-winding type and can prevent, in advance, a failure and the like of the device caused by winding of a tape in a direction opposite to a proper winding direction, and a circulation-type paper sheet processing device provided with the circulation-type paper sheet storing device.

Solution to Problem

In order to solve the above problem, the present invention provides a paper sheet circulation device comprising: a tape in a form of a long strip; a drum that supports one end in a longitudinal direction of the tape and winds and feeds the tape by rotating in a forward direction and a reverse direction; and a bobbin that supports the other end in the longitudinal direction of the tape and feeds and winds the tape by rotating in a forward direction and a reverse direction, the device retaining a paper sheet supplied from outside by sandwiching the paper sheet between the tapes and winding the paper sheet and the tapes in a multilayer state on an outer circumference of the drum, wherein the device comprises: a travelling-direction mark having a pattern that is formed along a travelling-direction of the tape and indicates a difference of a travelling-direction of the tape; a mark detection sensor that detects the travelling-direction mark and outputs a detection signal, a pattern acquisition unit that acquires a pattern signal in accordance with a travelling-direction of the tape on a basis of a temporal change of the detection signal; and a travelling-direction determination unit that determines a travelling-direction of the tape from the pattern signal.

Advantageous Effects of Invention

According to the present invention, it is possible to prevent, in advance, a failure or the like of a device caused by winding of a tape on a drum in a wrong direction.

BRIEF DESCRIPTION OF DRAWINGS

FIG. 5 is a schematic diagram illustrating an example of a travelling-direction mark.

FIG. 6 are respectively a schematic diagram for explaining a relation between a winding direction of a tape on a drum and a travelling-direction of the tape, where FIG. 6(*a*) illustrates a normal state and FIG. 6(*b*) illustrates a reverse-winding state.

DESCRIPTION OF EMBODIMENTS

A tape-winding type paper sheet circulation device according to the present invention has features that a mark indicating a travelling-direction of a tape is formed on the tape to enable detection of the travelling-direction of the tape and that it can be determined, from the travelling-direction of the tape and a rotation direction of a drum that winds the tape thereon, whether the state of winding of the tape on the drum is normal.

In the following embodiment, there is described a device which stores therein or delivers a banknote as an example of a paper sheet. Constituent elements, types, combinations, shapes, and relative arrangements thereof described in the embodiment are merely explanatory examples, and are not intended to limit the scope of the present invention solely thereto unless otherwise specified.

[Basic Configuration of Banknote Circulation Device]

Figure 1:
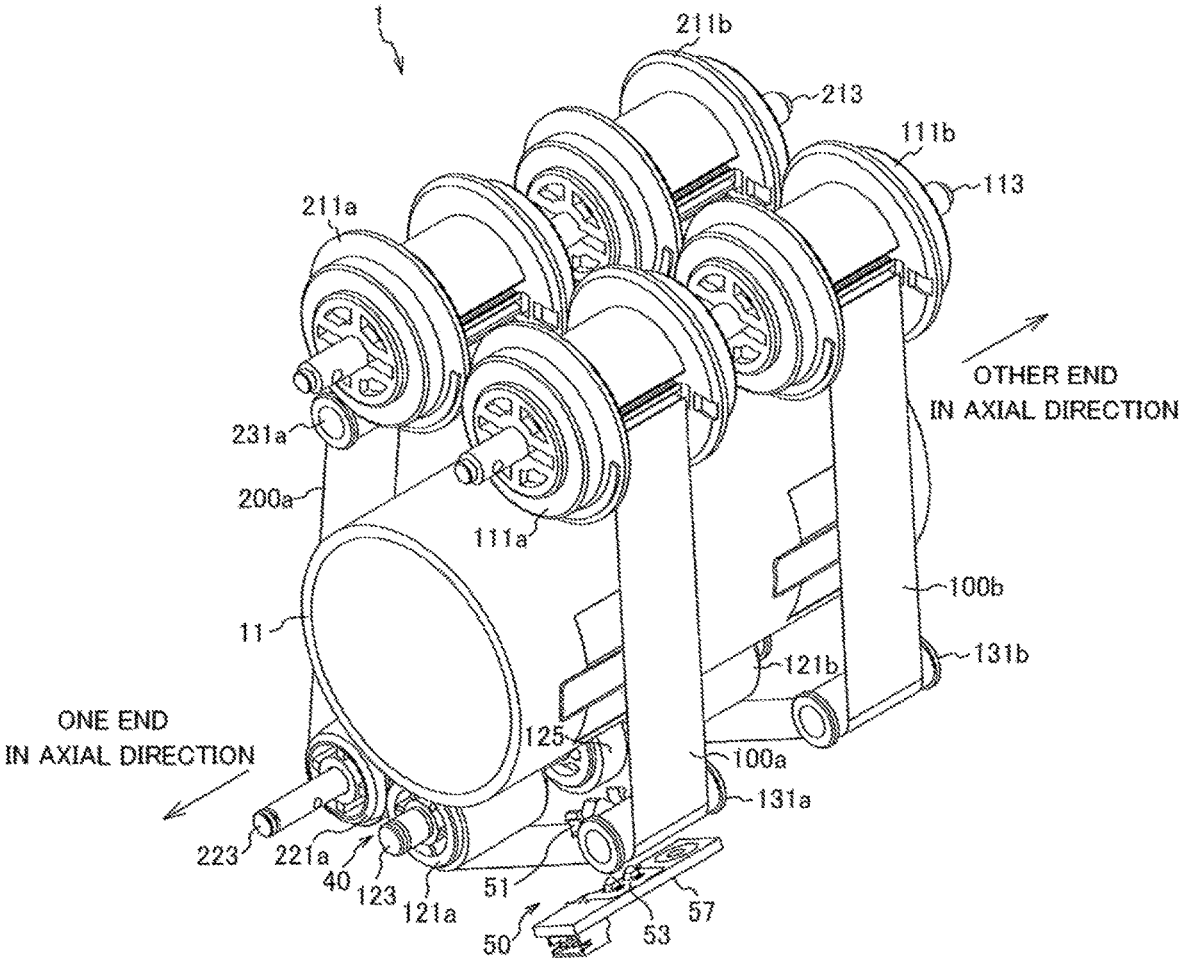
FIG. 1 is a perspective view illustrating a schematic configuration of a banknote circulation device according to an embodiment of the present invention.
Figure 2A:
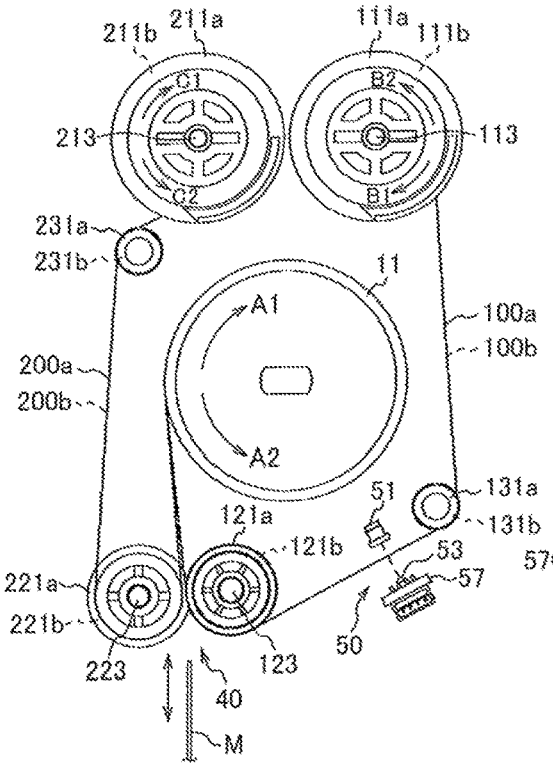
FIG. 2 are respectively a diagram illustrating a schematic configuration of the banknote circulation device according to the embodiment of the present invention, where FIG. 2(*a*) is a front view and FIG. 2(*b*) is a right side view.
Figure 2B:
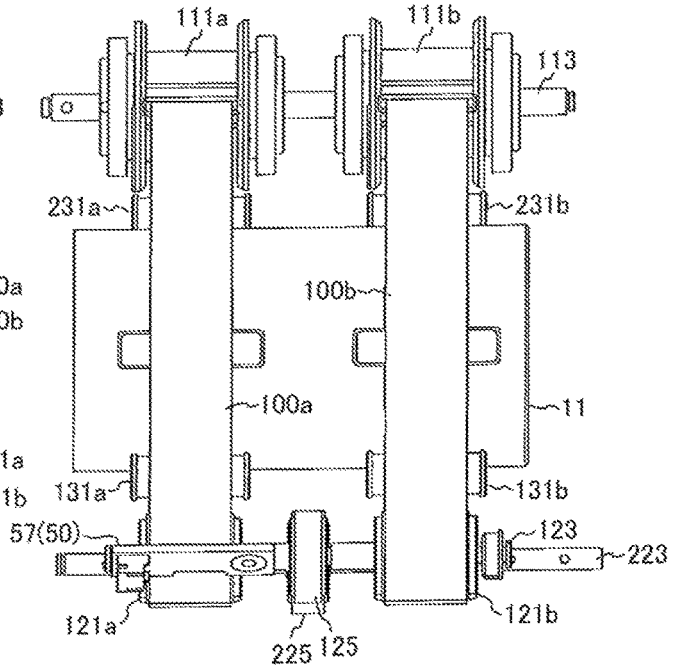

FIG. 1 is a perspective view illustrating a schematic configuration of a banknote circulation device according to an embodiment of the present invention. FIG. 2 are respectively a diagram illustrating a schematic configuration of the banknote circulation device according to the embodiment of the present invention, where FIG. 2(*a*) is a front view and FIG. 2(*b*) is a right side view.

A banknote circulation device 1 includes a first tape 100 (100*a*, 100*b*) and a second tape 200 (200*a*, 200*b*) in the form of long strips, a drum 11 that winds and feeds the first tape 100 and the second tape 200 by rotating in a forward direction and a reverse direction while supporting (fixing) one ends in a longitudinal direction of the first tape 100 and the second tape 200, a first bobbin 111 (111*a*, 111*b*) that feeds and winds the first tape 100 by rotating in a forward direction and a reverse direction while supporting (fixing) the other end in the longitudinal direction of the first tape 100, and a second bobbin 211 (211*a*, 211*b*) that feeds and winds the second tape 200 by rotating in a forward direction and a reverse direction while supporting (fixing) the other end in the longitudinal direction of the second tape 200.

The drum 11 winds the first tape 100*a* and the second tape 200*a* on its outer circumferential surface close to its one axial end while overlapping the tapes on each other in a multilayer state, and also winds the first tape 100*b* and the second tape 200*b* on the outer circumferential surface close to the other axial end while overlapping the tapes on each other in a multilayer state.

The first bobbins 111*a* and 111*b* have a first bobbin shaft 113 as a common rotation shaft. The first bobbins 111*a* and 111*b* are spaced away from each other in an axial direction of the first bobbin shaft 113, and support (fix) the other ends in the longitudinal direction of the first tapes 100*a* and 100*b*, respectively. Most of each of the first tapes 100*a* and 100*b* is wound around the corresponding bobbin 111 in an initial state before the first bobbins 111*a* and 111*b* feed the respective tapes.

The second bobbins 211*a* and 211*b* have a second bobbin shaft 213 as a common rotation shaft. The second bobbins 211*a* and 211*b* are spaced away from each other in an axial direction of the second bobbin shaft 213, and support (fix) the other ends in the longitudinal direction of the second tapes 200*a* and 200*b*, respectively. Most of each of the second tapes 200*a* and 200*b* is wound around the corresponding bobbin 211 in an initial state before the second bobbins 211*a* and 211*b* feed the respective tapes.

The banknote circulation device 1 includes a first guide roller 121 (121*a*, 121*b*) and a second guide roller 221 (221*a*, 221*b*) that bend the first tape 100 and the second tape 200 respectively fed from the first bobbin 111 and the second bobbin 211 toward the drum 11 and form a banknote slot 40. The banknote slot 40 receives a banknote M transported from outside between the first tape 100 and the second tape 200 that have joined together to be overlapped on each other (between opposed surfaces), or delivers the received banknote M to outside.

The first guide rollers 121*a* and 121*b* are supported by a first guide shaft 123 that is a common rotation shaft, to be rotatable in a forward direction and in a reverse direction integrally with the first guide shaft 123, and the second guide rollers 221*a* and 221*b* are supported by a second guide shaft 223 that is a common fixed shaft, to be rotatable in a forward direction and in a reverse direction relative to the second guide shaft 223.

A banknote supplied through the banknote slot 40 to between the first tape 100 and the second tape 200 is wound on the drum 11 together with the first tape 100 and the second tape 200 in a multilayer state and are stored.

A first idle roller 131 (131*a*, 131*b*) and a second idle roller 231 (231*a*, 231*b*) are arranged between the first bobbin 111 and the first guide roller 121 and between the second bobbin 211 and the second guide roller 221, respectively. The first idle roller 131 and the second idle roller 231 respectively guide the first tape 100 and the second tape 200 toward the first and second bobbins 111 and 211 and the first and second guide rollers 121 and 221.

Further, as illustrated in FIGS. 1 and 2(*b*), a first assist roller 125 axially supported by the first guide shaft 123 to be rotatable in a forward direction and a reverse direction integrally with the first guide shaft 123 is arranged between the first guide rollers 121*a* and 121*b*, and a second assist roller 225 axially supported by the second guide shaft 223 to be rotatable in a forward direction and a reverse direction relative to the second guide shaft 223 is arranged between the second guide rollers 221*a* and 221*b*. The first assist roller 125 and the second assist roller 225 configure the banknote slot 40 together with the first guide roller 121 and the second guide roller 221, and assist transport of a banknote received through the banknote slot 40 to between the first tape 100 and the second tape 200 or transport of a banknote delivered from between the first tape 100 and the second tape 200.

The drum 11 configures a banknote storing unit that stores therein a banknote supplied from outside while sandwiching it between the first tape 100 and the second tape 200 that are overlapped in a multilayer state and are wound on the outer circumference of the drum 11 (between opposed surfaces).

When rotating in a banknote-storing direction (a direction of the arrow A1 in FIG. 2(*a*)), the drum 11 winds the first tape 100 and the second tape 200, which have sandwiched the banknote supplied from outside through the banknote slot 40 therebetween, on the outer circumference of the drum 11 while overlapping them in a multilayer state, thereby storing the banknote in an outer circumferential portion of the drum 11. In this rotation, the first bobbin 111 and the second bobbin 211 rotate in a direction of the arrow B1 and a direction of the arrow C1 in FIG. 2(*a*) to feed the first tape 100 and the second tape 200, respectively.

When rotating in a banknote-dispensing direction (a direction of the arrow A2 in FIG. 2(*a*)), the drum 11 feeds the first tape 100 and the second tape 200 and also delivers the banknote stored and sandwiched between the first and second tapes 100 and 200 to outside through the banknote slot 40. In this rotation, the first bobbin 111 and the second bobbin 211 rotate in a direction of the arrow B2 and a direction of the arrow C2 in FIG. 2(*a*) to wind the first tape 100 and the second tape 200, respectively.

[Driving Mechanism]

A configuration of a driving mechanism that achieves the operations of the drum and the bobbins described above is described.

Figure 3A:
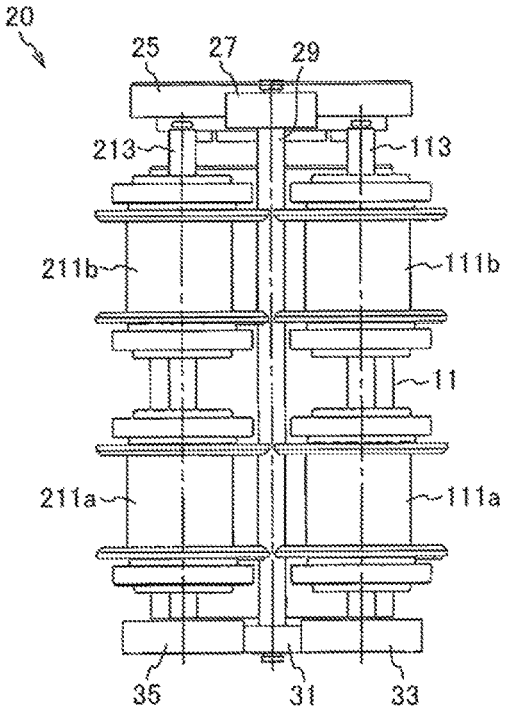
FIG. 3 are respectively a schematic diagram illustrating a driving mechanism for a drum and bobbins, where FIG. 3(*a*) is a plan view, FIG. 3(*b*) is a front view, and FIG. 3(*c*) is a left side view.
Figure 3C:
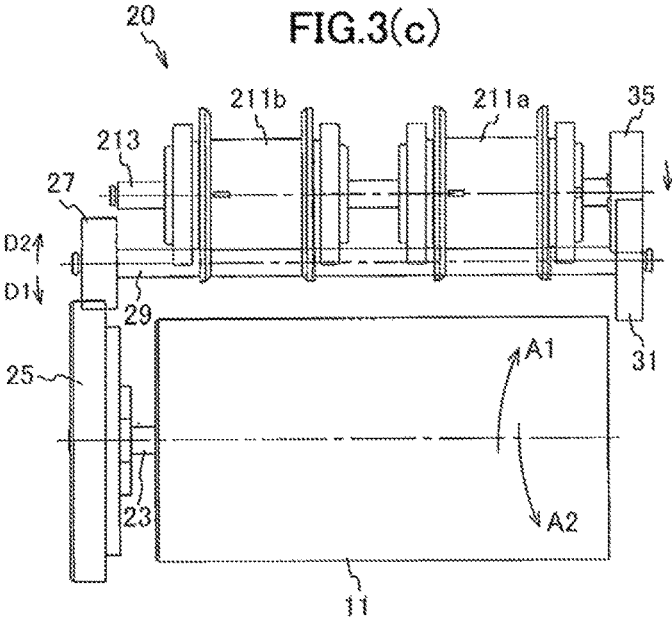
Figure 3B:
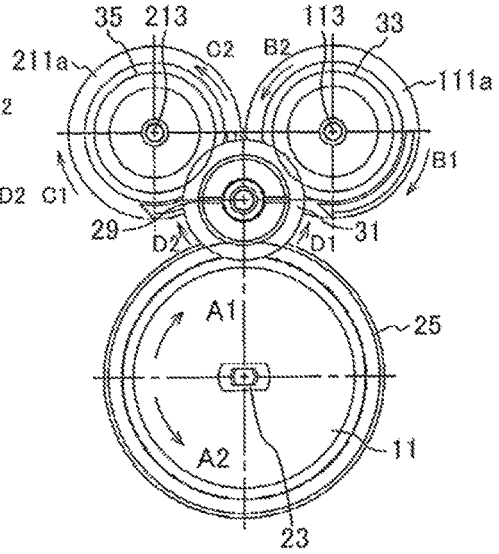

FIG. 3 are respectively a schematic diagram illustrating the driving mechanism for the drum and the bobbins, where FIG. 3(*a*) is a plan view, FIG. 3(*b*) is a front view, and FIG. 3(*c*) is a left side view.

A driving mechanism 20 includes a driving source (not illustrated), such as a motor, that is included in the drum 11 and causes forward rotation and reverse rotation of the drum 11 in a storing direction in which a banknote is stored (the direction of the arrow A1) and a dispensing direction in which a banknote is dispensed (the direction of the arrow A2), a drum gear 25 connected to a drum shaft 23 that is a rotation shaft of the drum 11 and rotating integrally with the drum 11, a first idle gear 27 engaging with the drum gear 25, a second idle gear 31 connected to an idle shaft 29 that is a rotation shaft of the first idle gear 27 integrally with the idle shaft 29, a first bobbin gear 33 and a second bobbin gear 35 that engage with the second idle gear 31, and the first bobbin shaft 113 and the second bobbin shaft 213 that are respectively rotation shafts of the first bobbin gear 33 and the second bobbin gear 35.

The first idle gear 27 has a built-in one-way clutch that limits a rotation direction of the idle shaft 29 and the second idle gear 31 to one direction. When the drum 11 and the drum gear 25 rotate in the dispensing direction (the direction of the arrow A2 in FIG. 3) and the first idle gear 27 rotates in a direction of the arrow D2, the one-way clutch causes the idle shaft 29 and the second idle gear 31 to rotate in the direction of the arrow D2 integrally with the first idle gear 27. On the other hand, when the drum 11 and the drum gear 25 rotate in the storing direction (the direction of the arrow A1 in FIGS. 3) and the first idle gear 27 rotates in a direction of the arrow D1, the one-way clutch causes the idle shaft 29 and the second idle gear 31 to idle with respect to the first idle gear 27.

The first bobbins 111*a* and 111*b* and the first bobbin shaft 113 rotate integrally with each other because of static friction force acting between them in a case where rotation thereof is not limited. In a case where friction force exceeding the maximum static friction force is generated between the first bobbins 111*a* and 111*b* and the first bobbin shaft 113, the first bobbins 111*a* and 111*b* slip on the first bobbin shaft 113 and rotate relative to the first bobbin shaft 113. That is, the first bobbin shaft 113 and the first bobbins 111*a* and 111*b* function as a torque limiter. The relation between the second bobbins 211*a* and 211*b* and the second bobbin shaft 213 is also the same as the relation described above.

[Operations of Driving Mechanism]

Operations of the driving mechanism are as described below.

First, an operation in a case where the drum 11 rotates in a dispensing direction is described. When the drum 11 rotates in a dispensing direction (the direction of the arrow A2), the drum shaft 23 and the drum gear 25 rotate in the same direction integrally with each other. This rotation is transmitted to the first idle gear 27 via the drum gear 25, so that the first idle gear 27 rotates in the direction of the arrow D2. The one-way clutch built in the first idle gear 27 transmits the rotation in the direction of the arrow D2 to the idle shaft 29 and the second idle gear 31.

Rotation of the second idle gear 31 is transmitted to the first bobbin gear 33, so that the first bobbin gear 33 rotates in the direction of the arrow B2. The first bobbin 111 rotates in the direction of the arrow B2 because of the rotation of the first bobbin gear 33 and the first bobbin shaft 113. The rotation of the second idle gear 31 is also transmitted to the second bobbin gear 35, so that the second bobbin gear 35 rotates in the direction of the arrow C2. The second bobbin 211 rotates in the direction of the arrow C2 because of the rotation of the second bobbin gear 35 and the second bobbin shaft 213.

As described above, when the drum 11 rotates in the dispensing direction (the direction of the arrow A2), the drum 11 feeds the first and second tapes 100 and 200, and the first bobbin 111 and the second bobbin 211 rotate in the direction of the arrow B2 and the direction of the arrow C2 to wind the first tape 100 and the second tape 200 fed from the drum 11, respectively.

Gear ratios of the gears included in the driving mechanism 20 are set in such a manner that the length of a tape wound by each of the first bobbin 111 and the second bobbin 211 in unit time is larger than the length of a tape fed by the drum 11 in unit time. Therefore, a predetermined magnitude of tension always acts on the tapes fed from the drum 11, so that the tapes are respectively wound on the first bobbin 111 and the second bobbin 211 without being slack.

If the tension on the tapes becomes larger during winding of the tapes around the first bobbin 111 and the second bobbin 211 and the friction force acting between the first and second bobbins 111 and 211 and the first and second bobbin shafts 113 and 213 exceeds the maximum static friction force, the first and second bobbins 111 and 211 rotate relative to the first and second bobbin shafts 113 and 213, respectively. Therefore, it is possible to wind the tapes around the first bobbin 111 and the second bobbin 211 without causing the tapes to be slack, while preventing break of the tapes.

Subsequently, an operation in a case where the drum 11 rotates in a storing direction is described. When the drum 11 rotates in a storing direction (the direction of the arrow A1), the drum shaft 23 and the drum gear 25 rotate in the same direction integrally with each other. This rotation is transmitted to the first idle gear 27 via the drum gear 25, so that the first idle gear 27 rotates in the direction of the arrow D1. The one-way clutch built in the first idle gear 27 does not transmit the rotation in the direction of the arrow D1 to the idle shaft 29. Therefore, the second idle gear 31, the first bobbin gear 33, the second bobbin gear 35, the first bobbin shaft 113, and the second bobbin shaft 213 that are located downstream of the idle shaft 29 in a power transmitting direction do not rotate.

When the drum 11 rotates in the storing direction, the drum 11 winds the tapes while pulling out the tapes from the first bobbin 111 and the second bobbin 211. Therefore, a predetermined magnitude of tension always acts on the tapes, and the tapes are wound on the drum 11 without being slack. If the tension on the tapes becomes larger during winding of the tapes on the drum 11 and the friction force acting between the first bobbin 111 and the first bobbin shaft 113 and that acting between the second bobbin 211 and the second bobbin shaft 213 exceed the maximum static friction force, the first and second bobbins 111 and 211 rotate relative to the first and second bobbin shafts 113 and 213, respectively. Therefore, it is possible to wind the tapes on the drum 11 without causing the tapes to be slack, while preventing break of the tapes.

Accordingly, when the drum 11 rotates in the storing direction (the direction of the arrow A1), the first bobbin 111 and the second bobbin 211 rotate in a direction of feeding respective tapes (the direction of the arrow B1 and the direction of the arrow C1) because of tension acting on the respective tapes during winding of the first tape 100 and the second tape 200 by the drum 11.

As described above, the driving mechanism 20 operates in such a manner that the amount of a tape wound by each of the first and second bobbins 111 and 211 is more than the amount of a tape fed from the drum 11 when the drum 11 rotates in a dispensing direction, and the amount of a tape fed from each of the first and second bobbins 111 and 211 is less than the amount of a tape wound by the drum 11 when the drum 11 rotates in a storing direction, thereby preventing the tapes from being slack.

[Basic Configuration of Tape]

Returning to FIGS. 1 and 2, each of the first and second tapes 100 and 200 is made of a resin film material that is soft and flexible and has low elasticity. The first tape 100*b* and the second tapes 200*a* and 200*b* are formed by a transparent tape that allows visible light, for example, to pass therethrough, over the entire length in the longitudinal direction. The first tape 100*a* is formed by an identical material to the first tape 100*b* and the second tape 200, but is different from the above tapes 100*b* and 200 in that detection marks (a travelling-direction mark 310 and a trailing end mark 301) are formed at both ends in the longitudinal direction.

A detailed configuration of the first tape 100*a* as a detection tape provided with detection marks will be described later.

[Sensor Module]

A sensor module (a mark detection sensor) 50 that detects detection marks added on the first tape 100*a* is arranged at an appropriate position in the banknote circulation device 1, the position facing the first tape 100*a*, as illustrated in FIGS. 1 and 2.

The sensor module 50 described in the present embodiment is a through-beam type photoelectric sensor module configured to include a light-emitting unit 51 and a light-receiving substrate 57. The light-emitting unit 51 includes a light-emitting element (for example, an LED or a laser diode) that radiates detecting light to the first tape 100*a*. The light-receiving substrate 57 includes, for example, a light-receiving element (a photoelectric conversion element, a light receiving unit 53) that receives the detecting light, and a processing circuit including an A/D converter that converts an analog detection signal output from the light-receiving element into a digital detection signal. The light-emitting unit 51 and the light-receiving substrate 57 are arranged to be opposed to each other while sandwiching therebetween the first tape 100*a* that is not overlapped. The sensor module 50 outputs a detection signal having a level (an intensity) corresponding to optical characteristics of the first tape 100*a*.

[Detection Tape]

Figure 4:
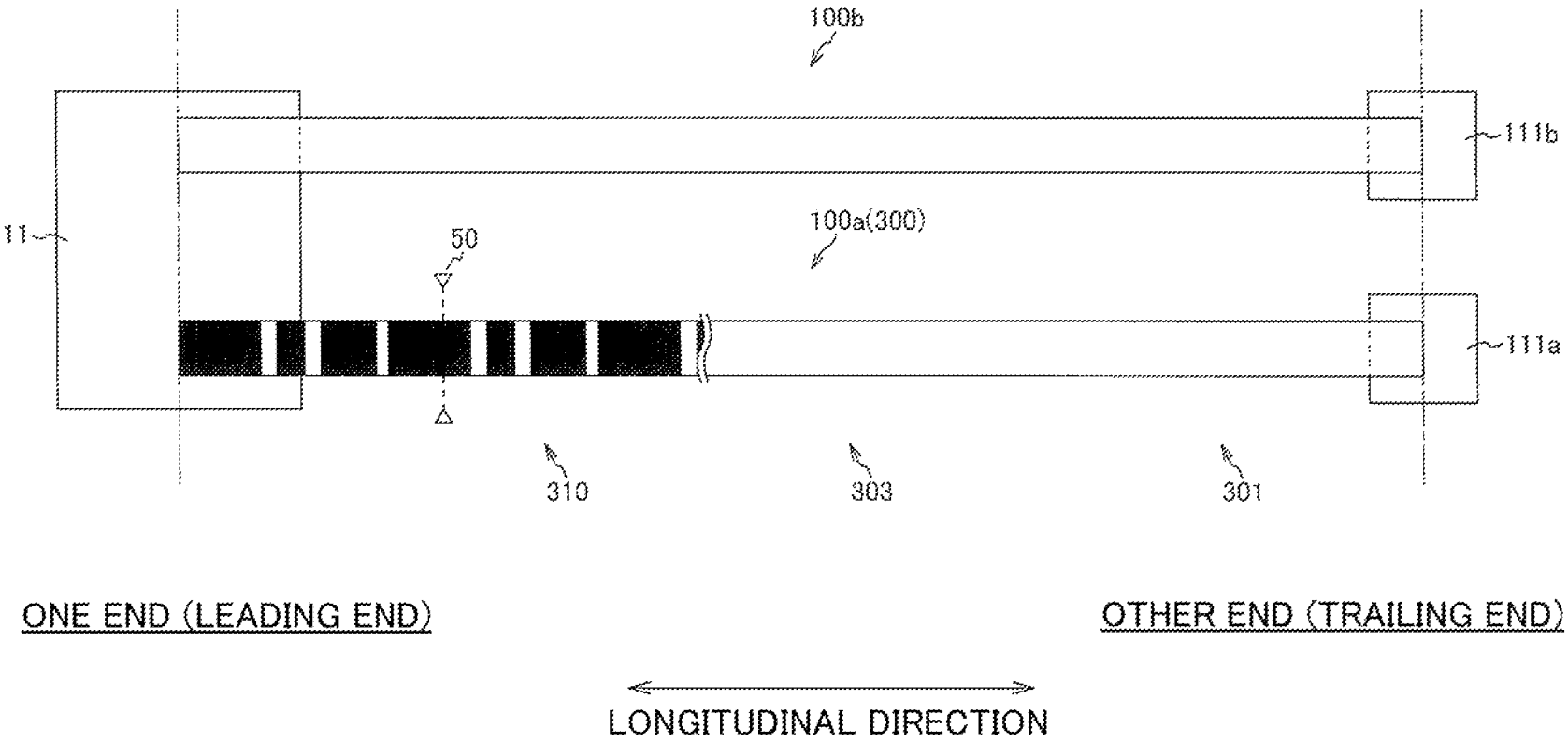
FIG. 4 is a schematic diagram illustrating a state of supporting a tape by a drum and bobbins.

FIG. 4 is a schematic diagram illustrating a state of supporting a tape by a drum and bobbins.

The first tapes 100*a* and 100*b* are supported by the drum 11 at one ends in the longitudinal direction (leading ends) and by the first bobbins 111*a* and 111*b* at the other ends in the longitudinal direction (trailing ends). In the following descriptions, the first tape 100*a* is referred to as "detection tape 300".

The detection tape 300 has the travelling-direction mark 310 (a travelling-direction detection region) for indicating a travelling-direction at one end in the longitudinal direction. The detection tape 300 also has the trailing end mark 301 (a trailing-end detection region) for indicating a trailing end at the other end in the longitudinal direction. Further, an intermediate portion in the longitudinal direction of the detection tape 300 is a non-detection region 303 that is not detected by the sensor module 50, and is a transparent region that allows detecting light of the sensor module 50 to pass therethrough in this example.

The travelling-direction mark 310 is formed by a pattern in which a transparent region that allows detecting light to pass therethrough and a light-shielding region that shields the detecting light appear alternately and regularly. The trailing end mark 301 is formed only by a light-shielding region that shields the detecting light.

<Travelling-Direction Mark>

FIG. 5 is a schematic diagram illustrating an example of a travelling-direction mark.

The travelling-direction mark 310 has a plurality of sets of regular patterns 311 that are formed along a travelling-direction of the detection tape 300 and indicate the difference of the travelling-direction of the detection tape 300. The travelling-direction mark 310 is configured in such a manner that a temporal change of a detection signal output from the sensor module 50 (a pattern signal) is different between when the detection tape 300 travels in a storing direction (a direction of the arrow E1 in FIG. 5) in which the detection tape 300 is wound on the drum 11 (see FIG. 4) and when the detection tape 300 travels in a dispensing direction (a direction of the arrow E2 in FIG. 5) in which the detection tape 300 is fed from the drum 11.

The travelling-direction mark 310 has a plurality of patterns 311 that are continuously repeated along a longitudinal direction. Each pattern 311 includes at least three types of light-shielding regions 311*a*, 311*b*, and 311*c* as constituent elements, which are arranged along the longitudinal direction and are different from one another in the state of the detection signal output from the sensor module 50 (an output pattern of the detection signal). The pattern 311 described in this example is configured to include the three light-shielding regions 311*a*, 311*b*, and 311*c* that are different from one another in the length in the longitudinal direction. The relative lengths in the longitudinal direction of the light-spieling regions 311*a*, 311*b*, and 311*c* are short, medium, and long. Transparent regions 312 that are the same in the length in the longitudinal direction are arranged between the light-shielding regions 311*a*, 311*b*, and 311*c*.

When the detection tape 300 travels in the storing direction (the direction of the arrow E1 in FIG. 5), the sensor module 50 detects the travelling-direction mark 310 in the order of the light-shielding regions 311*a*, 311*b*, 311*c*, 311*a*, 311*b*, 311*c*, . . . . On the other hand, when the detection tape 300 travels in the dispensing direction from the drum (the direction of the arrow E2 in FIG. 5), the sensor module 50 detects the travelling-direction mark 310 in the order of the light-shielding regions 311*c*, 311*b*, 311*a*, 311*c*, 311*b*, 311*a*, . . . .

In this manner, the travelling-direction mark 310 is arranged in such a manner that the arranging order of the lengths of light-shielding regions in a case where the detection tape 300 is wound on the drum 11 and that in a case where the detection tape 300 is fed from the drum 11 are asymmetric. That is, each pattern 311 is formed so that two types of pattern signals that are different are output in accordance with the travelling-direction.

[Winding Direction of Tape on Drum]

When a banknote jam occurs inside the banknote circulation device 1, an operator may manually rotate the drum 11 in a banknote-dispensing direction to remove the jammed banknote. However, if the operator excessively rotates the drum 11 in a state where the remaining amount of the tape wound on the drum 11 is low, the remaining tape may be all fed from the drum 11 and rotation in the same direction continued thereafter may cause the tape to be wound on the drum 11 in a direction opposite to a proper winding direction.

FIG. 6 are respectively a schematic diagram for explaining a relation between a winding direction of a tape on a drum and a travelling-direction of the tape, where FIG. 6(*a*) illustrates a normal state and FIG. 6(*b*) illustrates a reverse-winding state. In FIG. 6, a case where the drum 11 rotates in a banknote-dispensing direction (the direction of the arrow A2 in FIG. 6) is described by way of example.

In the normal state illustrated in FIG. 6(*a*), the first tape 100 and the second tape 200 are wound on the drum 11 without being largely curved from the banknote slot 40. When the drum 11 rotates in the direction of the arrow A2 that is the dispensing direction in the normal state, the detection tape 300 travels in the direction of the arrow E2.

In the reverse-winding state illustrated in FIG. 6(*b*), the first tape 100 and the second tape 200 are wound on a circumferential surface of the drum 11 after being largely curved in an S-shape from the banknote slot 40. Because a banknote is sharply curved on the drum 11 side of the banknote slot 40, the banknote cannot be stored and delivered smoothly, which may cause a banknote jam or a failure of the banknote circulation device 1. In a case where the winding direction of the tape is a reverse direction, when the drum 11 rotates in the direction of the arrow A2 that is the dispensing direction, the detection tape 300 travels in the direction of the arrow E1 opposite to the arrow E2 that is a transport direction in the normal state.

As described above, in the state where reverse winding occurs, despite the rotation of the drum 11 in the dispensing direction, the detection tape 300 travels in the storing direction, that is, a reverse direction to the direction in the normal state. Therefore, if a rotation direction of the drum 11 and a travelling-direction of the detection tape 300 are found, it is possible to determine whether the first tape 100 and the second tape 200 are wound on the drum 11 in a proper direction.

[Functional Block Diagram]

Figure 7:
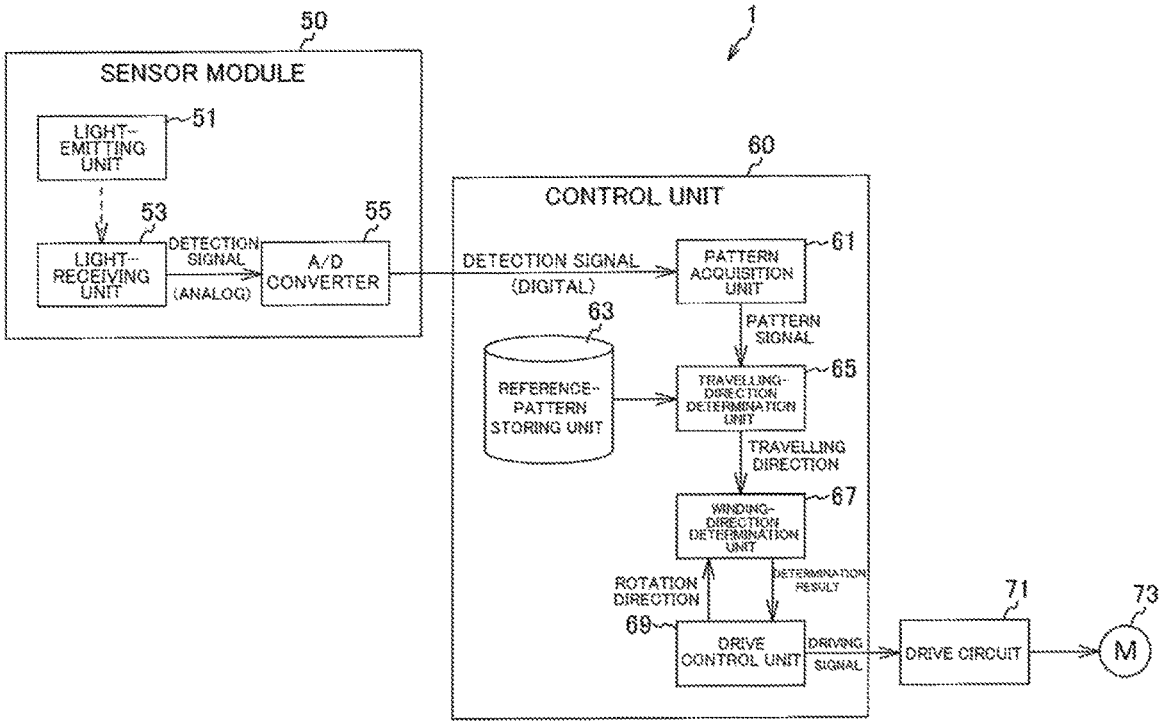
FIG. 7 is a functional block diagram illustrating a schematic configuration of a control unit and its periphery of the banknote circulation device.

FIG. 7 is a functional block diagram illustrating a schematic configuration of a control unit and its periphery of a banknote circulation device.

The banknote circulation device 1 includes the sensor module 50, a control unit 60, a drive circuit 71, and a motor 73.

The sensor module 50 includes the light-emitting unit 51, the light-receiving unit 53, and an A/D converter 55 as described with reference to FIGS. 1 and 2, and detects the travelling-direction mark 310 (see FIGS. 4 to 6) and outputs a digital detection signal. The A/D converter may be arranged in the control unit 60 instead of in the sensor module 50.

The control unit 60 determines a winding direction of a tape on the drum 11 on the basis of the digital detection signal input from the sensor module 50, and generates a driving signal.

The control unit 60 includes a pattern acquisition unit (pattern acquisition unit) 61, a reference-pattern storing unit (reference-pattern storing unit) 63, a travelling-direction determination unit (travelling-direction determination unit) 65, a winding-direction determination unit (winding-direction determination unit) 67, and a drive control unit 69.

The control unit 60 is constituted of a microcomputer or the like including, for example, a CPU (Central Processing Unit), a ROM (Read Only Memory), a RAM (Random Access Memory), and an input/output interface. The CPU, the ROM, the RAM, and the input/output interface are connected to each other through a bus.

The CPU is a processor that controls each unit of a banknote circulation device. The ROM is a non-volatile memory unit that stores therein a program and data used for processing. The RAM is a volatile memory unit used by the CPU as a working memory area. The CPU loads and executes the program stored in the ROM on the RAM to implement the functions of the control unit 60 illustrated in FIG. 7. The input/output interface is a unit that transmits a signal to and receives a signal from an external device, and inputs a digital detection signal from the sensor module 50 and outputs a driving signal to the drive circuit 71.

The pattern acquisition unit 61 acquires (generates) a pattern signal in accordance with a travelling-direction of a detection tape on the basis of a temporal change of the digital detection signal. For example, the pattern acquisition unit 61 acquires a pattern signal corresponding to the pattern 311 illustrated in FIG. 5.

The reference-pattern storing unit 63 is a unit that stores therein a reference pattern to be compared with the pattern signal.

The travelling-direction determination unit 65 compares the reference pattern read from the reference-pattern storing unit 63 and the pattern signal output from the pattern acquisition unit 61 with each other to determine which one of a storing direction and a dispensing direction the detection tape travels in.

The winding-direction determination unit 67 is a unit that determines whether the winding direction of a tape on the drum 11 is a forward direction or a reverse direction on the basis of information on the travelling-direction of the tape determined by the travelling-direction determination unit 65 (travelling-direction data) and information on a rotation direction of the motor 73 driven and controlled by the drive control unit 69 (rotation-direction data).

The drive control unit 69 is a unit that generates and outputs a driving signal for controlling the drive circuit 71 that causes the motor 73 to rotate. In a case where the winding direction of the tape determined by the winding-direction determination unit 67 is a reverse direction, the drive control unit 69 generates a driving signal that causes the motor 73 to be stopped once and then rotate in an opposite direction. The drive control unit 69 also provides the information on the rotation direction of the motor 73 (the rotation-direction data) to the winding-direction determination unit 67.

The drive circuit 71 drives the motor 73 that causes the drum 11 to rotate in a forward direction and a reverse direction, on the basis of a driving signal from the control unit 60.

[Summary of Processing]

Figure 8:
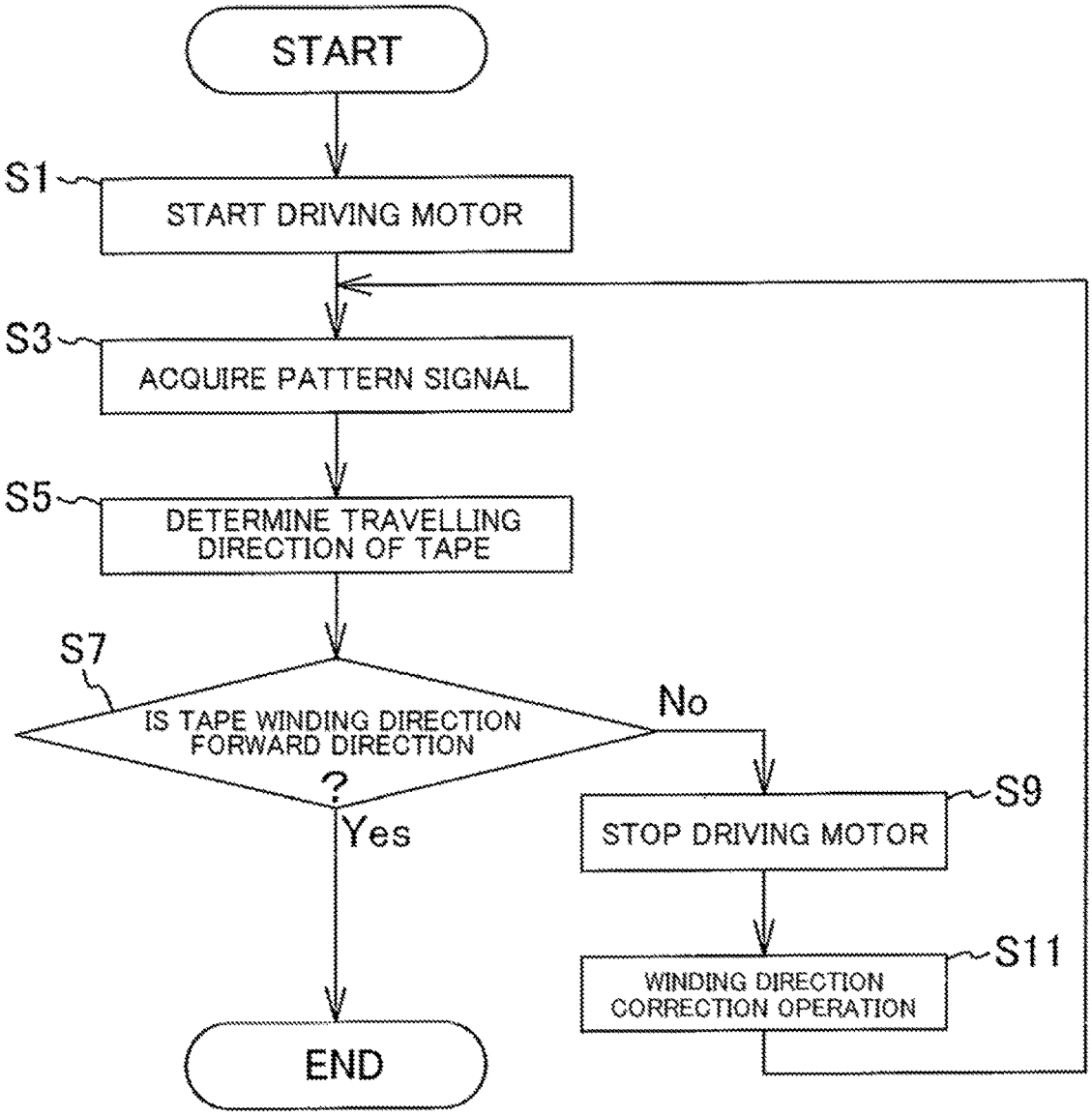
FIG. 8 is a flowchart for explaining an operation of a control unit.
Figure 9A:
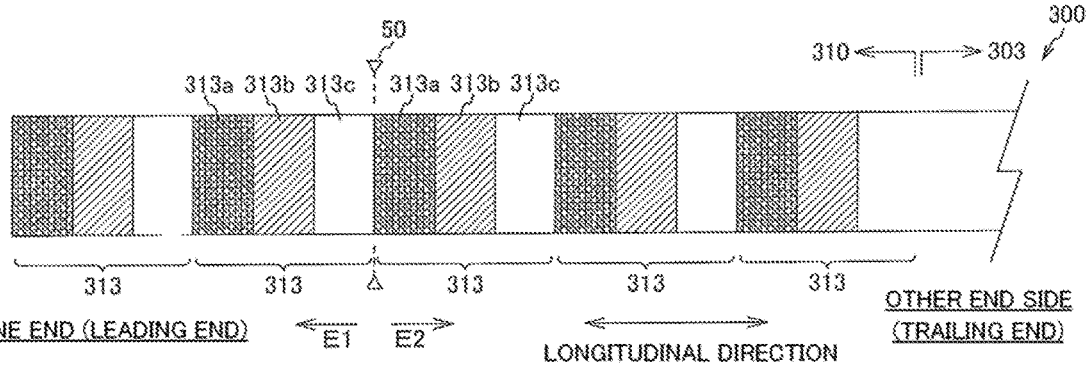
FIGS. 9(*a*) to 9(*d*) are schematic diagrams respectively illustrating a modification of a travelling-direction mark.
Figure 9B:
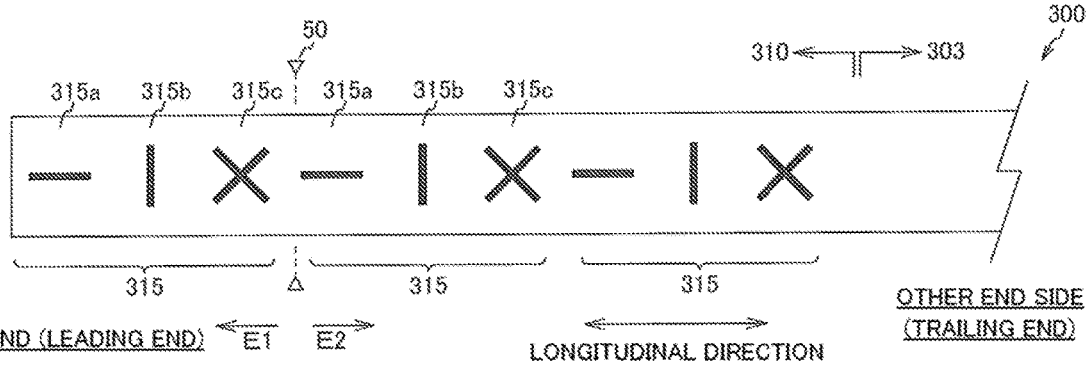
Figure 9C:
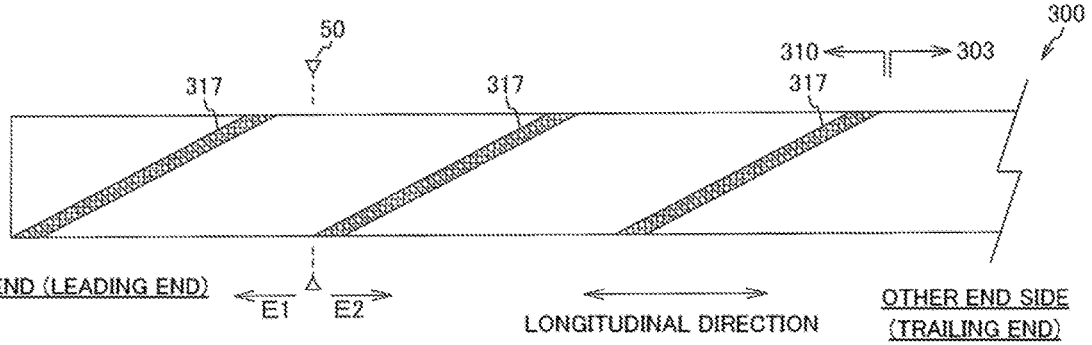
Figure 9D:
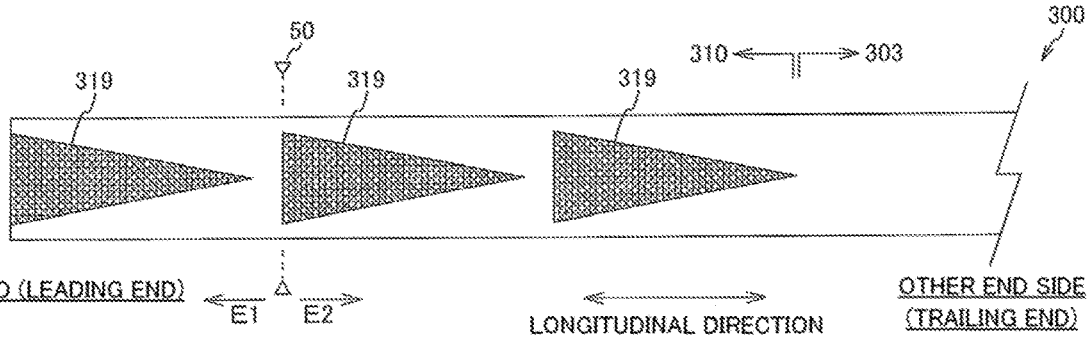

FIG. 8 is a flowchart for explaining an operation of a control unit.

At step S1, the drive control unit 69 generates a driving signal that causes the motor 73 to rotate in a predetermined rotation direction (a storing direction or a dispensing direction) and outputs the driving signal to the drive circuit 71. The motor 73 is driven to rotate on the basis of the driving signal, so that the detection tape 300 travels. The light-emitting unit 51 of the sensor module 50 radiates detecting light to the detection tape 300. When the detection tape 300 travels, the travelling-direction mark 310 is detected by the sensor module 50. The light-receiving unit 53 of the sensor module 50 outputs an analog detection signal having an intensity in accordance with the surface state of the detection tape 300. The A/D converter 55 converts the analog detection signal to a digital detection signal and outputs the digital detection signal to the control unit 60.

At step S3, the pattern acquisition unit 61 inputs the digital detection signal thereto, and acquires a pattern signal corresponding to a pattern of the travelling-direction mark from the digital detection signal that varies with time. For example, the pattern acquisition unit 61 recognizes a series of signals containing one detection signal corresponding to each of the three light-shielding regions 311*a* to 311*c*, regarding a detection signal having a level corresponding to any of the light-shielding regions 311*a* to 311*c* that is detected immediately after the transparent region 312 illustrated in FIG. 5 as a starting point, and generates the recognized series of signals as a pattern signal.

At step S5, the travelling-direction determination unit 65 compares a reference pattern read from the reference-pattern storing unit 63 and the pattern signal with each other to determine which one of a storing direction and a dispensing direction the detection tape 300 travels in. Here, information indicating travelling-directions of the detection tape 300 is made to correspond to respective reference patterns stored in the reference-pattern storing unit 63. The travelling-direction determination unit 65 extracts a reference pattern that matches the pattern signal, and determines a travelling-direction made to correspond to this reference pattern as an actual travelling-direction of the detection tape 300. The travelling-direction determination unit 65 also outputs information on the travelling-direction of the detection tape 300 (the travelling-direction data) to the winding-direction determination unit 67.

At step S7, the winding-direction determination unit 67 determines whether the winding direction of the first and second tapes 100 and 200 on the drum 11 is a forward direction or a reverse direction on the basis of the information on the travelling-direction of the detection tape 300 acquired from the travelling-direction determination unit 65 and information on the rotation direction of the drum 11 acquired from the drive control unit 69.

Here, the phrase that the winding direction of the first and second tapes 100 and 200 is the forward direction means that the first and second tapes 100 and 200 travel in the storing direction (or the dispensing direction) and the drum 11 rotates in the storing direction in which a banknote is stored normally (or a dispensing direction in which a banknote is dispensed normally, a proper direction). Further, the phrase that the winding direction of the first and second tapes 100 and 200 is the reverse direction means that the first and second tapes 100 and 200 travel in the storing direction and the drum 11 rotates in the dispensing direction in which a banknote is dispensed normally (a non-normal direction).

In a case where the winding direction of the first and second tapes 100 and 200 on the drum 11 is the forward direction (Yes at step S7), the control unit 60 ends processing. In a case where the winding direction of the first and second tapes 100 and 200 on the drum 11 is the reverse direction (No at step S7), processes at step S9 and thereafter are performed.

At step S9, the drive control unit 69 controls the drive circuit 71 to stop driving the motor 73. That is, the drive control unit 69 generates a driving signal that temporarily stops driving the motor 73, and outputs it to the drive circuit 71.

At step S11, the drive control unit 69 performs an operation for correcting the winding direction of the first and second tapes 100 and 200. First, the drive control unit 69 controls the drive circuit 71 to cause the motor 73 to rotate in an opposite direction. That is, the drive control unit 69 generates a driving signal that causes the motor 73 to rotate in the storing direction, and outputs it to the drive circuit 71.

Further, as described with reference to FIG. 3, in the present embodiment in which the driving mechanism 20 is provided which uses gear ratios, a one-way clutch, and a torque limiter function for adjusting tension of the tapes 100 and 200, the bobbins 111 and 211 do not rotate in the directions of the arrows B2 and C2, respectively, even if the drum 11 is caused to rotate in the direction of the arrow A1 in FIG. 6 to eliminate reverse winding of the tapes 100 and 200. Consequently, the tapes 100 and 200 are slack. Therefore, the drive control unit 69 alternately executes control of causing the drum 11 to rotate in the direction of the arrow A1 and control of causing the drum 11 to rotate in the direction of the arrow A2. In this case, the drive control unit 69 generates a driving signal to satisfy "time in which drum 11 is caused to rotate in direction of arrow A2"<"time in which drum 11 is caused to rotate in direction of arrow A1", and outputs the driving signal to the drive circuit 71.

After performing the process at step S11, the control unit 60 performs the processes at step S3 and thereafter, confirms that the winding direction of the first and second tapes 100 and 200 on the drum 11 is normal at step S7, and ends processing.

Advantageous Effects of Present Embodiment

As described above, according to the present embodiment, different marks are added at a leading end and a trailing end of the detection tape 300. Therefore, by causing the detection tape 300 to travel, it is possible to determine a position in the longitudinal direction on the detection tape 300 (the leading end, an intermediate portion, or the trailing end) only by including one sensor module 50 (a detection sensor). According to the present embodiment, it is unnecessary to provide a plurality of sensors unlike Patent Literature 1. Therefore, miniaturization and space saving of the banknote circulation device 1 can be achieved.

According to the present embodiment, the travelling-direction mark 310 indicating the difference of the travelling-direction is added on the detection tape 300. Therefore, it is possible to determine which one of a dispensing direction in which a banknote is dispensed and a storing direction in which a banknote is stored the detection tape 300 travels in.

According to the present embodiment, it is possible to determine whether the detection tape 300 is wound on the drum 11 in a proper direction or a reverse direction on the basis of information on a travelling-direction of the detection tape 300 and information on a rotation direction of the drum 11 that winds the detection tape 300 thereon. If the detection tape 300 is wound in the reverse direction, it is possible to automatically rewind the detection tape 300 in the proper direction by stopping rotation of the drum 11 and driving the drum 11 to rotate in the reverse direction, so that a failure or the like of the banknote circulation device 1 can be prevented in advance.

Although a through-beam type photoelectric sensor is used as a sensor module in this example, the banknote circulation device 1 uses a sensor that can detect each of the travelling-direction mark 310 and the trailing end mark 301 added on the detection tape 300 in accordance with physical properties of each mark. As the sensor, it is possible to use various sensors, for example, a photoelectric sensor that detects the difference of a transmittance, a reflectance, or a color as an optical property of each mark, an image sensor that captures an image of each mark (a line sensor or an area sensor), and a magnetic sensor that detects the difference of a magnetic property between marks. Each mark may be visible by human eyes or not visible.

Further, the information on the rotation direction of the drum 11 may be acquired via a rotary encoder attached to the drum 11, for example, other than the drive control unit 69.

Furthermore, the banknote circulation device 1 may include a notification unit (such as a speaker, a lamp, or a display device such as a liquid crystal display panel) that notifies, when the winding direction of the detection tape 300 on the drum 11 is determined as a reverse direction, outside of that determination by sound, light, an indication using characters and pictures, and the like.

[Modifications of Travelling-Direction Mark]

FIGS. 9(*a*) to 9(*d*) are schematic diagrams respectively illustrating a modification of a travelling-direction mark.

As illustrated in FIG. 9(*a*), the travelling-direction mark 310 includes a plurality of patterns 313 each of which has a regular arrangement of three constituent elements 313*a*, 313*b*, and 313*c* that are different from one another in a transmittance of detecting light and are arranged along the longitudinal direction in a predetermined order. For example, the transmittance of detecting light is 0% in the constituent element 313*a*, 50% in the constituent element 313*b*, and approximately 100% in the constituent element 313*c*. The lengths in the longitudinal direction of the constituent elements 313*a*, 313*b*, and 313*c* described in this modification are the same as one another, but may be different from one another.

The constituent elements 313*a* to 313*c* are detected in the order of the constituent elements 313*a*, 313*b*, and 313*c* by the sensor module 50 when the detection tape 300 travels in the storing direction (the direction of the arrow E1), and are detected in the order of the constituent elements 313*c*, 313*b*, and 313*a* by the sensor module 50 when the detection tape 300 travels in the dispensing direction (the direction of the arrow E2).

Also in this modification, the travelling-direction mark 310 is arranged in such a manner that the detection order of the constituent elements 313*c*, 313*b*, and 313*a* is asymmetric in accordance with the travelling-direction of the detection tape 300. Therefore, the banknote circulation device 1 can detect the travelling-direction of the detection tape 300.

As illustrated in FIG. 9(*b*), the travelling-direction mark 310 includes a plurality of patterns 315 each of which has a configuration in which three different designs (constituent elements) 315*a*, 315*b*, and 315*c* are arranged along the longitudinal direction in a predetermined order. The designs 315*a*, 315*b*, and 315*c* in this modification can be detected by using the sensor module 50 configured by a line image sensor including a plurality of photoelectric conversion elements arranged along a short-side direction of the detection tape 300, an area image sensor (a camera) that can capture an image of a predetermined area range in the detection tape 300, or the like.

The designs 315*a* to 315*c* of the travelling-direction mark 310 are detected in the order of the designs 315*a*, 315*b*, and 315*c* by the sensor module 50 when the detection tape 300 travels in the storing direction (the direction of the arrow E1), and are detected in the order of the designs 315*c*, 315*b*, and 315*a* by the sensor module 50 when the detection tape 300 travels in the dispensing direction (the direction of the arrow E2).

Also in this modification, the travelling-direction mark 310 is arranged in such a manner that the detection order of the designs 315*c*, 315*b*, and 315*a* is asymmetric in accordance with the travelling-direction of the detection tape 300. Therefore, the banknote circulation device 1 can detect the travelling-direction of the detection tape 300.

As illustrated in FIG. 9(*c*), the travelling-direction mark 310 is configured by patterns 317, 317, . . . , whose position in the short-side direction (whose appearing position in the short-side direction) continuously changes in accordance with a change of a position in the longitudinal direction on the detection tape 300. The pattern 317 is a pattern whose position detected by the sensor module 50 changes along the short-side direction. The travelling-direction mark 310 may include only one pattern 317 or a plurality of patterns 317.

The patterns 317 of this modification can be detected by the sensor module 50 configured by a line image sensor including a plurality of photoelectric conversion elements arranged along the short-side direction of the detection tape 300, an area image sensor (a camera) that can capture an image of a predetermined area range in the detection tape 300, or the like.

The pattern 317 is detected by the sensor module 50 as a design that continuously moves from one end in the short-side direction (a lower side in FIG. 9(*c*)) to the other end (an upper side in FIG. 9(*c*)) when the detection tape 300 travels in the storing direction (the direction of the arrow E1), and is detected by the sensor module 50 as a design that continuously moves from the other end in the short-side direction to the one end when the detection tape 300 travels in the dispensing direction (the direction of the arrow E2).

Also in this modification, the travelling-direction mark 310 is arranged in such a manner that the detected position (the appearing position) of the pattern 317 in the short-side direction of the detection tape 300 and the moving direction (the changing direction) of the pattern 317 are asymmetric in accordance with the travelling-direction of the detection tape 300. Therefore, the banknote circulation device 1 can detect the travelling-direction of the detection tape 300.

As illustrated in FIG. 9(*d*), the travelling-direction mark 310 includes patterns 319, 319, . . . , whose length in the short-side direction (and whose position in the short-side direction or whose appearing position in the short-side direction) continuously changes in accordance with a change of a position in the longitudinal direction on the detection tape 300. The travelling-direction mark 310 may include only one pattern 319 or a plurality of patterns 319.

The patterns 319 of this modification can be detected by the sensor module 50 configured by a line image sensor including a plurality of photoelectric conversion elements arranged along the short-side direction of the detection tape 300, an area image sensor (a camera) that can capture an image of a predetermined area range in the detection tape 300, or the like.

The pattern 319 is detected by the sensor module 50 as a design whose length in the short-side direction continuously changes to decrease when the detection tape 300 travels in the storing direction (the direction of the arrow E1), and is detected by the sensor module 50 as a design whose length in the short-side direction continuously changes to increase when the detection tape 300 travels in the dispensing direction (the direction of the arrow E2).

Also in this modification, the travelling-direction mark 310 is arranged in such a manner that the changing direction of the length in the short-side direction of the pattern 319 is asymmetric in accordance with the travelling-direction of the detection tape 300. Therefore, the banknote circulation device 1 can detect the travelling-direction of the detection tape 300.

[Banknote Handling Device]

Figure 10:
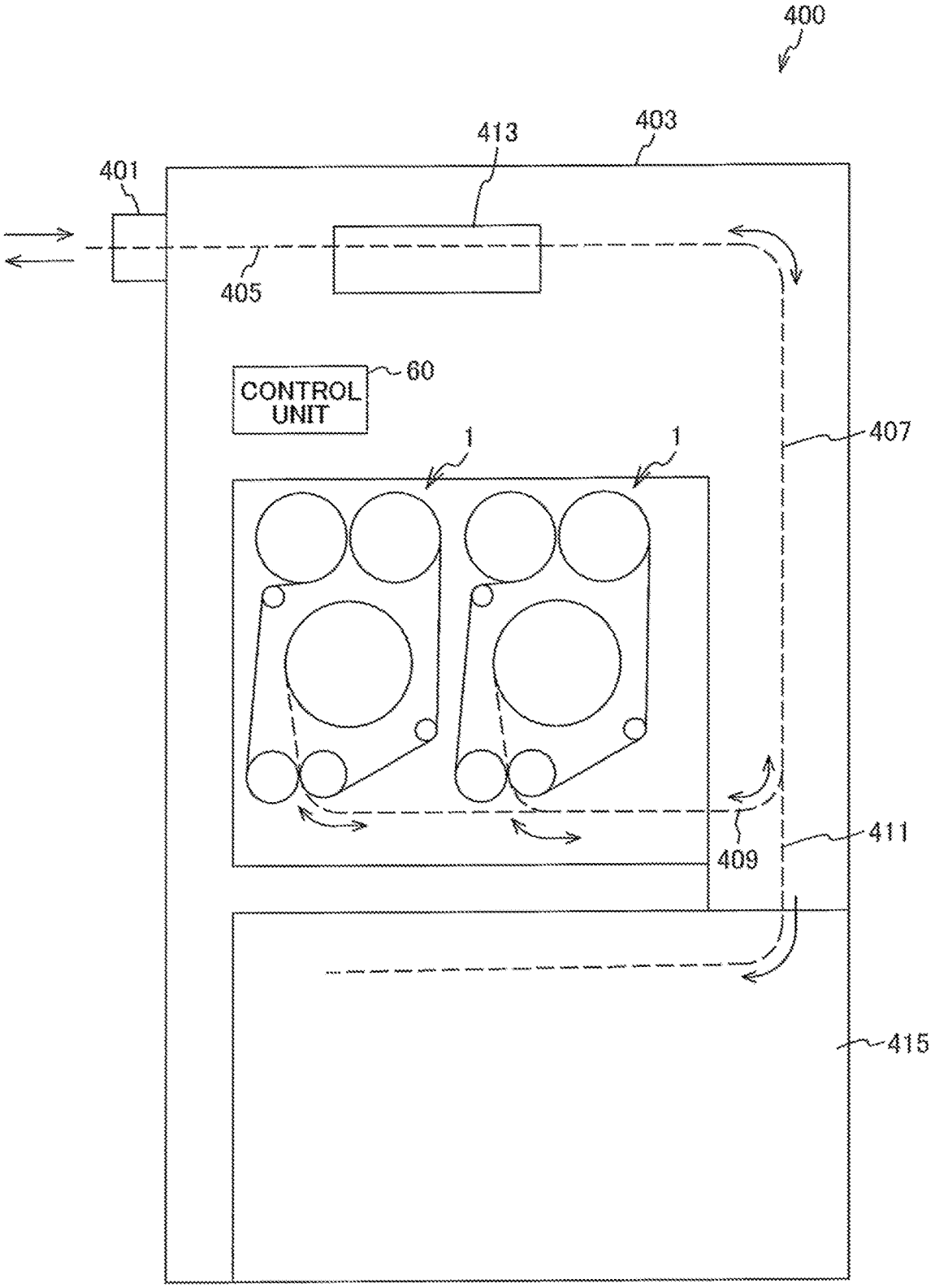
FIG. 10 is an explanatory diagram of a schematic configuration of a circulation-type banknote processing device as an example of a banknote handling device to which the banknote circulation device according to the embodiment of the present invention is applied.

FIG. 10 is an explanatory diagram of a schematic configuration of a circulation-type banknote processing device as an example of a banknote handling device to which the banknote circulation device according to the embodiment of the present invention is applied.

A circulation-type banknote processing device (a paper sheet handling device) 400 generally includes, for example, a housing 403 having a banknote depositing/dispensing port 401 in its front side, a depositing/dispensing path 405, a back transport path 407, a circulation path 409, and a non-circulation path 411 that are arranged in the housing 403, a banknote recognition unit 413 that determines, for example, whether a banknote introduced from the banknote depositing/dispensing port 401 has a missing part, determines the denomination of the introduced banknote, and determines whether the introduced banknote is genuine, the banknote circulation devices 1 and 1 each of which receives a banknote introduced from the circulation path 409 by denomination, a non-circulation banknote repository 415 that stores therein a banknote introduced from the non-circulation path 411, a transport driving mechanism that is configured by a roller, a belt, a motor, and the like and transports a banknote along the depositing/dispensing path 405, the back transport path 407, the circulation path 409, and the non-circulation path 411, and the control unit 60 that controls the constituent elements described above.

A banknote received from the banknote depositing/dispensing port 401 one by one is transported to the banknote recognition unit 413 via the depositing/dispensing path 405. If the banknote recognition unit 413 determines that the banknote introduced from the banknote depositing/dispensing port 401 is not acceptable, the control unit 60 controls the transport driving mechanism to return this banknote through the banknote depositing/dispensing port 401. If the banknote recognition unit 413 determines that the banknote introduced from the banknote depositing/dispensing port 401 is acceptable and genuine, the control unit 60 controls the transport driving mechanism to sort this banknote to any of the banknote circulation devices 1 and 1 or to the non-circulation banknote repository 415 by denomination. When a dispense instruction for a specified denomination is received, the control unit 60 delivers a banknote of that denomination from a corresponding one of the banknote circulation devices 1 and 1 and controls the transport driving mechanism to transport this banknote to the banknote depositing/dispensing port 401 via the back transport path 407 and the depositing/dispensing path 405.

The circulation-type banknote processing device 400 can also operate to perform switch-back transport of a banknote delivered from each of the banknote circulation devices 1 and 1 and to store it in the non-circulation banknote repository 415.

It is possible to apply the banknote circulation device described in the embodiment described above to various types of vending machines, money changers, cash dispensers, and other various types of money handling devices. Further, the banknote circulation device is not limited to a device that handles banknotes, and may be a device that handles securities, tickets, ballots, envelopes, or various types of other paper sheets.

Summary of Examples of Modes, Actions, and Advantageous Effects of Present Invention <First Mode>

The present mode is a paper sheet circulation device (the banknote circulation device 1) that includes a tape in the form of a long strip (the first tape 100, the second tape 200), the drum 11 that supports one end in a longitudinal direction of the tape and winds and feeds the tape by rotating in a forward direction and a reverse direction, and a bobbin (the first bobbin 111, the second bobbin 211) that supports the other end in the longitudinal direction of the tape and feeds and winds the tape by rotating in a forward direction and a reverse direction, the paper sheet circulation device retaining a paper sheet (the banknote M) supplied from outside by sandwiching it between the tapes and winding the paper sheet and the tapes in a multilayer state on an outer circumference of the drum. The paper sheet circulation device is characterized by including the travelling-direction mark 310 that has a pattern 311 formed along a travelling-direction of the tape (the first tape 100*a*, the detection tape 300) to indicate the difference of the travelling-direction of the tape, a mark detection sensor (the sensor module 50) that detects the travelling-direction mark and outputs a detection signal, a pattern acquisition unit (the pattern acquisition unit 61) that acquires a pattern signal in accordance with the travelling-direction of the tape on the basis of a temporal change of the detection signal, and a travelling-direction determination unit (the travelling-direction determination unit 65) that determines the travelling-direction of the tape from the pattern signal.

In the present mode, because the travelling-direction mark having the pattern that indicates the difference of the travelling-direction is added on the tape, it is possible to determine, on the basis of a signal acquired from the travelling-direction mark (the pattern signal), which one of a dispensing direction in which the paper sheet is dispensed and a storing direction in which the paper sheet is stored the tape travels in.

By using information on the travelling-direction of the tape, it is possible to determine whether a winding direction of the tape on the drum is normal. More specifically, in a case where the tape travels in a dispensing direction (or a storing direction) and the drum rotates in a direction in which the paper sheet is dispensed (or is stored) normally, the winding direction of the tape on the drum can be determined as being normal. On the other hand, in a case where the drum rotates in a direction in which the paper sheet is dispensed normally although the tape travels in the storing direction, the winding direction of the tape on the drum can be determined as being reverse.

As described above, according to the present mode, it is possible to obtain information on the travelling-direction of a tape required for determination of a winding direction of the tape on a drum. Therefore, by using this information, it is possible to prevent, in advance, a failure or the like of a device caused by winding of the tape on the drum in a wrong direction.

<Second Mode>

A paper sheet circulation device according to the present mode (the banknote circulation device 1) is characterized by including a winding-direction determination unit (the winding-direction determination unit 67) that determines whether the winding direction of the tape on the drum is normal or abnormal from a travelling-direction of the tape (the detection tape 300) and a rotation direction of the drum.

From information on the travelling-direction of the tape and information on the rotation direction of the drum, it is possible to determine the winding direction of the tape on the drum by the winding-direction determination unit. If the tape is wound on the drum in a reverse direction, it is possible to perform an operation of preventing a failure of a device in advance, such as an operation of stopping rotation of the drum once and then causing the drum to rotate in the reverse direction to make the winding direction of the tape on the drum normal.

<Third Mode>

A paper sheet circulation device according to the present mode (the banknote circulation device 1) is characterized in that the travelling-direction mark 310 has the pattern 311 that includes at least three types of constituent elements (the light-shielding regions 311*a* to 311*c*) that are arranged along a longitudinal direction of the tape (the detection tape 300) and are different from one another in an output pattern of a detection signal.

If the travelling-direction mark includes at least three types of constituent elements, the detection order of the constituent elements can be changed in accordance with the travelling-direction of the tape and it is therefore possible to determine the travelling-direction of the tape.

<Fourth Mode>

A paper sheet circulation device according to the present mode (the banknote circulation device 1) is characterized in that the travelling-direction mark 310 includes the pattern 317 whose position detected by the mark detection sensor (the sensor module 50) changes in the short-side direction.

Also in a case where the detection position of the pattern configuring the travelling-direction mark changes in the short-side direction, the detection position of the pattern in the short-side direction and a changing direction of that detection position can be made asymmetric in accordance with the travelling-direction of the detection tape. Therefore, it is possible to detect the travelling-direction of the detection tape.

<Fifth Mode>

A paper sheet circulation device according to the present mode (the banknote circulation device 1) is characterized in that the travelling-direction mark 310 is added at one end in the longitudinal direction of the tape (the detection tape 300).

By providing the travelling-direction mark at one end in the longitudinal direction of the tape, that is, at an end supported by the drum 11, it is possible to determine the winding direction in an initial phase where the tape starts to be wound on the drum, and it is easy to rewind the tape on the drum.

<Sixth Mode>

A paper sheet handling device according to the present mode (the circulation-type banknote processing device 400) is characterized by including the paper sheet circulation device (the banknote circulation device 1).

The present mode can provide a paper sheet handling device having the effects of the modes described above.

REFERENCE SIGNS LIST

1 . . . banknote circulation device, 11 . . . drum, 20 . . . driving mechanism, 23 . . . drum shaft, 25 . . . drum gear, 27 . . . first idle gear, 29 . . . idle shaft, 31 . . . second idle gear, 33 . . . first bobbin gear, 35 . . . second bobbin gear, 40 . . . banknote slot, 50 . . . sensor module, 51 . . . light-emitting unit, 53 . . . light-receiving unit, 55 . . . A/D converter, 57 . . . light-receiving substrate, 60 . . . control unit, 61 . . . pattern acquisition unit, 63 . . . reference-pattern storing unit, 65 . . . travelling-direction determination unit, 67 . . . winding-direction determination unit, 69 . . . drive control unit, 71 . . . drive circuit, 73 . . . motor, 100,100*a*, 100*b* . . . first tape, 111,111*a*,111*b* . . . first bobbin, 113 . . . first bobbin shaft, 121,121*a*,121*b* . . . first guide roller, 123 . . . first guide shaft, 125 . . . first assist roller, 131 . . . first idle roller, 200,200*a*,200*b* . . . second tape, 211,211*a*, 211*b* . . . second bobbin, 213 . . . second bobbin shaft, 221,221*a*,221*b* . . . second guide roller, 223 . . . second guide shaft, 225 . . . second assist roller, 231 . . . second idle roller, 300 . . . detection tape, 301 . . . trailing end mark, 303 . . . non-detection region, 310 . . . travelling-direction mark, 311 . . . pattern, 311*a*,311*b*,311*c* . . . light-shielding region, 312 . . . transparent region, 313 . . . pattern, 313*a*, 313*b*, 313*c* . . . pattern, 315 . . . pattern, 315*a*,315*b*,315*c* . . . pattern, 317 . . . pattern, 319 . . . pattern, 400 . . . circulation-type banknote processing device, 401 . . . banknote depositing/dispensing port, 403 . . . housing, 405 . . . depositing/dispensing path, 407 . . . back transport path, 409 . . . circulation path, 411 . . . non-circulation path, 413 . . . banknote recognition unit, 415 . . . non-circulation banknote repository, M . . . banknote

The invention claimed is:

1. A paper sheet circulation device comprising:

two tapes in a form of a long strip;

a drum that supports one end in a longitudinal direction of each of the tapes and winds and feeds each of the tapes by rotating in a forward direction and a reverse direction; and two bobbins that support the other end in the longitudinal direction of each of the tapes and feed and wind each of the tapes by rotating in a forward direction and a reverse direction, where the device retaining a paper sheet supplied from outside by sandwiching the paper sheet between the tapes and winding the paper sheet and the tapes in a multilayer state on an outer circumference of the drum, wherein the device comprises:

a travelling-direction mark having a pattern that is formed along a travelling-direction of the tapes and indicates a difference of a travelling-direction of the tapes;

a mark detection sensor that detects the travelling-direction mark and outputs a detection signal;

a pattern acquisition unit that acquires a pattern signal in accordance with a travelling-direction of the tapes on a basis of a temporal change of the detection signal; and a travelling-direction determination unit that determines a travelling-direction of the tapes from the pattern signal;

wherein the pattern of the travelling-direction mark having a pattern is asymmetric in accordance with the travelling-direction of the tapes.

2. The paper sheet circulation device according to claim 1, further comprising a winding-direction determination unit that determines whether a winding direction of the tape on the drum is normal or abnormal from a travelling-direction of the tape and a rotation direction of the drum.

3. The paper sheet circulation device according to claim 2, wherein the winding-direction determination unit is configured to determine that the winding direction of the tapes on the drum is abnormal, when the tapes travel in a first travelling-direction in which the tapes are wound and the drum rotates in a second rotation direction in which the paper sheets are dispensed normally (A2) or when the tapes travel in a second travelling-direction in which the tapes are fed from the drum and the drum rotates in a first rotation direction in which the paper sheets are stored normally (A1).

4. The paper sheet circulation device according to claim 3, further comprising a drive control unit configured to control a driving mechanism for driving the drum, wherein the drive control unit, when the winding-direction determination unit determines that the winding direction of the tapes on the drum is abnormal, is configured to perform an operation for correcting the winding direction of the tapes until the winding-direction determination unit determines that the winding direction of the tapes on the drum is normal, wherein the operation for correcting performs alternately the first control operation for rotating the drum in the first direction and the second control operation for rotating the drum in the second direction.

5. The paper sheet circulation device according to claim 1, wherein the travelling-direction mark has the pattern including at least three types of constituent elements that are arranged along a longitudinal direction of the tape and are different from one another in an output pattern of the detection signal.

6. The paper sheet circulation device according to claim 1, wherein the travelling-direction mark has the pattern whose position detected by the mark detection sensor changes in a short-side direction.

7. The paper sheet circulation device according to claim 1, wherein the travelling-direction mark is added at one end in a longitudinal direction of the tape.

8. The paper sheet circulation device according to claim 7, a trailing end mark indicating a trailing end is added at other end in a longitudinal direction of the tapes.

9. A paper sheet handling device comprising the paper sheet circulation device according to claim 1.

* * * * *